US008276769B2

(12) United States Patent
Hogeback

(10) Patent No.: US 8,276,769 B2
(45) Date of Patent: Oct. 2, 2012

(54) WINE RACK

(75) Inventor: Darryl Hogeback, Denver, CO (US)

(73) Assignee: Hogeback Woodworking, Inc., Denver, CO (US)

( * ) Notice: Subject to any disclaimer, the term of this patent is extended or adjusted under 35 U.S.C. 154(b) by 364 days.

(21) Appl. No.: 12/498,178

(22) Filed: Jul. 6, 2009

(65) Prior Publication Data

US 2010/0006523 A1 Jan. 14, 2010

Related U.S. Application Data

(60) Provisional application No. 61/078,030, filed on Jul. 3, 2008.

(51) Int. Cl.
*A47B 73/00* (2006.01)

(52) U.S. Cl. ..... 211/74

(58) Field of Classification Search ..... 211/189, 211/40, 74, 36, 37, 134, 71.01; 312/408, 312/128, 116; D7/701–708
See application file for complete search history.

(56) References Cited

U.S. PATENT DOCUMENTS

| | | | | | |
|---|---|---|---|---|---|
| 3,606,023 | A | * | 9/1971 | Edmunds | 211/74 |
| 4,093,076 | A | * | 6/1978 | Newton | 211/74 |
| 4,282,977 | A | * | 8/1981 | Di Lorenzo | 211/74 |
| D288,156 | S | * | 2/1987 | Nuncio | D6/468 |
| D289,716 | S | * | 5/1987 | Boland, II | D6/465 |
| D314,111 | S | * | 1/1991 | Ohno | D6/552 |
| 5,042,396 | A | * | 8/1991 | Shuert | 108/57.25 |
| 5,169,009 | A | * | 12/1992 | Bomze | 211/74 |
| D377,298 | S | * | 1/1997 | Campbell | D7/708 |
| 6,328,170 | B1 | * | 12/2001 | Lee | 211/59.2 |
| 6,364,129 | B1 | * | 4/2002 | Dardashti et al. | 211/40 |
| 6,454,108 | B1 | * | 9/2002 | Gerard | 211/74 |
| 6,722,510 | B1 | * | 4/2004 | Sen | 211/74 |
| 6,729,481 | B1 | * | 5/2004 | O'Brien | 211/74 |
| 6,994,222 | B2 | * | 2/2006 | Hunt | 211/40 |
| 7,007,815 | B2 | * | 3/2006 | Anderson et al. | 211/191 |
| 7,448,502 | B2 | * | 11/2008 | Hunt | 211/40 |
| 7,878,340 | B1 | * | 2/2011 | Olsen | 211/74 |
| D635,414 | S | * | 4/2011 | Hogeback | D7/701 |
| D635,833 | S | * | 4/2011 | Hogeback | D7/701 |
| 2003/0080073 | A1 | * | 5/2003 | Huang et al. | 211/40 |
| 2008/0217270 | A1 | * | 9/2008 | Lee et al. | 211/74 |
| 2008/0251478 | A1 | * | 10/2008 | Jaskowski | 211/74 |
| 2009/0071921 | A1 | * | 3/2009 | Harwin | 211/74 |
| 2009/0120886 | A1 | * | 5/2009 | Weiss et al. | 211/74 |
| 2011/0036791 | A1 | * | 2/2011 | Huang | 211/74 |

* cited by examiner

*Primary Examiner* — Jennifer E. Novosad
(74) *Attorney, Agent, or Firm* — Marsh Fischmann & Breyfogle LLP

(57) ABSTRACT

A wine rack for storing a plurality of wine bottles comprising one or more pairs of front and rear horizontal supports connected to a pair of vertical side supports. A plurality of support member pairs, extend between each pair of horizontal supports to support a wine bottle. The support members are perpendicularly oriented to front and rear horizontal supports, which secure the wine bottles and prevent their longitudinal movement toward the front and back of the wine rack. In various arrangements, the horizontal supports are arcuate to provide improved, accessibility and viewing of wine bottles stored on the rack.

6 Claims, 7 Drawing Sheets

WINE RACK

CROSS-REFERENCE TO RELATED APPLICATION

This application claims priority and the benefit of the filing date under 35 U.S.C. 119 to U.S. Provisional Application No. 61/078,030, entitled, "WINE RACK," filed on Jul. 3, 2008, the contents of which are incorporated herein as if set forth in full.

FIELD OF THE INVENTION

Embodiments of the present invention relate to wine racks, and more particularly to a wine rack suitable for storing and displaying wine bottles horizontally and axially, supported on a pair of substantially parallel dowels extending between adjacent horizontal frame supports.

BACKGROUND OF THE INVENTION

Conventionally, wine racks are used in wine cellars or other wine storage areas to store numerous bottles of wine in a desired area. In such conventional wine racks, the bottles of wine are supported along the length of the bottle within a grid of generally rectangular cavities stacked upon and next to each other, each rectangular cavity typically formed by pairs of parallel wood supports held in position by front and rear frame structures.

These wine racks are generally solidly built wooden structures, and the cavities are capable of storing one or more bottles of wine vertically stacked on top of each other. Thus, the nature of these types of wine racks generally results in the bottles being stored in close proximity to each other, preventing air circulation around the individual bottles and providing inadequate measures for securing the wine bottles in the event the rack is bumped, jostled or otherwise moves. Therefore, wine bottles may fall off the rack resulting in loss of the product and a significant mess to clean.

Also, in this example of a conventional wine rack, the wine rack is typically configured such that user places a bottle of wine longitudinally within one of the rectangular cavities such that when the rack is full of wine bottles, only the top ends (i.e., where the foil is wrapped around the top end) of the wine bottles are generally visible when viewing the wine rack—and the labels on the wine bottle are not generally visible by the user. As such, in order to determine which type of wine (e.g., varietals/grape type, winery name, vintage/year, etc.) is stored in a particular cavity of such a wine rack, the user may need to remove the bottle from the wine rack in order to view the label on the bottle.

It is, against this background that various embodiments of the present invention were developed.

SUMMARY OF THE INVENTION

In light of the above and according to one broad aspect of one embodiment of the invention, disclosed herein is a wine rack that provides stable, robust storage of wine bottles, and prevents bottles and labels from being damaged either by external force applied to the rack or by every day handling of wine bottles. Various configurations of wine racks may be formed using embodiments of the present invention. According to one broad aspect of one embodiment of the present invention, disclosed herein is a free-standing wine rack, which can be further secured by attachment to a wall or other surface.

The embodiments of the present invention provide a wine rack apparatus having a frame defining one or more rows having a plurality of "columns" configured for storing wine bottles or the like therein. Each row comprises a plurality of pairs of horizontally spaced-apart dowels generally parallel to one another and extending between horizontal front and rear supports of the frame. Each pair of dowels is spaced apart sufficiently to support a wine bottle or the like thereon and generally perpendicular to the horizontal frame supports. The length of each dowel is slightly longer than space between front and rear horizontal supports, and ends of each dowel are secured within suitable apertures bored into the these supports. In one embodiment, the diameter of the dowels is slightly smaller than the diameter of the apertures, permitting the dowels to rotate on their longitudinal axis, thus preventing damage to the wine label.

The number of bottles that can be supported by the rack is dependent on the length of the horizontal supports, the number of pairs of dowels, and the height of the side support structures, which determines the number of rows on the rack. The configuration of using individual dowel pairs for each wine bottle provides for improved air circulation around each bottle, and the open face of the rack provides easy viewing of the labels of bottles in the rack. Further, the spacing of the dowels may be selected to accommodate different bottle configurations. For instance, champagne and magnum wine bottles are typically differently sized than most standard wine bottles. Accordingly, components of the wine rack apparatus may be sized for different applications.

In one embodiment, the horizontal supports are formed from curved or bowed supports. Utilizing bowed supports allows for improving the visibility of bottles stored thereon. That is, bottles stored on the bowed supports are not directly aligned side by side. Rather, each wine bottle is slightly offset to the bottles adjacent thereto, which improves the visibility of each bottle. In such an embodiment, the horizontal supports may be concave or convex. In one particular arrangement, the bowed supports are made from wine barrel staves, which may originate from retired wine barrels. Use of such barrel staves also provides a wine rack system that may be made in whole or in part from recycled wood.

In another aspect, a wine rack provided that utilizes gravity to align the wine bottles on the horizontal supports. Again, such a wine rack includes a frame defining one or more columns having one or more rows configured for storing wine bottles or the like therein. Each row is formed form first and second bowed support members that extend between a pair of vertical supports that define a column. In one arrangement, the bowed supports are formed from barrel staves. The first and second barrel staves are disposed in a parallel fashion and define a surface for receiving wine bottles. Due to the curvature of the barrel staves, the wine bottles will roll to the center of the parallel barrel stave, or, to the outer edges of the barrel staves where they interface the vertical members of the wine rack. In further arrangements, the third stave may be utilized to form a backing plate. In a yet further arrangement, the first and/or second staves may be milled to provide one or more cut-outs or recesses for positioning wine bottles thereon.

In another aspect of the invention, a cabinet type wine rack is provided that includes a number of storage bins each of which is designed to store a plurality of stacked wine bottles. The storage bins are formed of a lattice of alternating support members that permit air to flow around that bottles thereby improving the storage conditions of the wine contained within the bins. More specifically, the wine rack includes at least first and second sidewalls and a bottom wall/floor extending there between. The wine rack may further include a top wall. These walls collectively define support surfaces. Bins are defined within the support surfaces using at least first and second sets of elongated supports. Each set of elongated supports has a first end that engages a first support surface and a second end that engages a second support surface. The ends of each set of elongated supports are aligned. However, the first set and second set of elongated supports engage the support surfaces at different locations. In this regard, the first and second set of supports are disposed at an angle to one another, such that bottles may be stacked in the crux between the support sets. Further, the elongated supports of each set alternate within the cabinet. In this regard, spaces exist between elongated supports of each set. These spaces define a lattice that permits airflow through the bins.

In one arrangement, the elongated support members are curved or bowed. In one particular arrangement, the bowed supports are made from wine barrel staves, which may originate from retired wine barrels. Use of such barrel staves also provides a wine rack system that may be made in whole or in part from recycled wood.

In another embodiment, a portion or all of the wine rack may be made from wood of retired wine barrels where the wine barrels are from an identified wine producer. In a further arrangement, the wine rack made from the barrels of the identified wine producer may be sold in conjunction with the wine that was previously held in the wine barrels.

Other embodiments of the invention are disclosed herein. The foregoing and other features, utilities and advantages of various embodiments of the invention will be apparent from the following more particular description of the various embodiments of the invention as illustrated in the accompanying drawings and claims.

DETAILED DESCRIPTION

Figure 1:
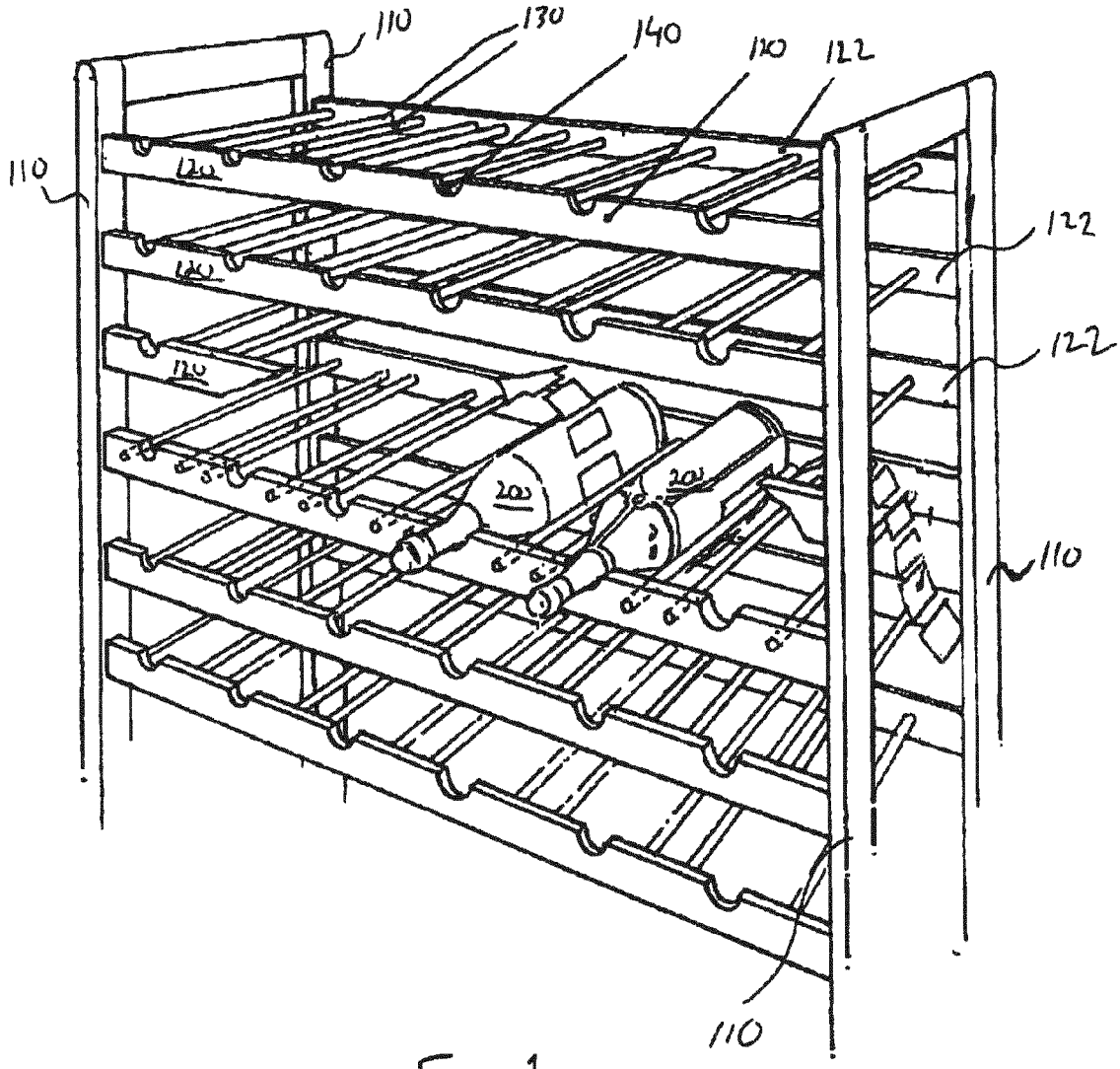
FIG. 1 illustrates one embodiment of a wine rack system in accordance with aspects of the invention.

Reference will now be made to the accompanying drawings, which assist in illustrating the various pertinent features of the wine rack design and associated marketing methods. Although the invention will now be described primarily in conjunction with a rack system for holding wine bottles, it should be expressly understood that the invention may be applicable to other applications where it is desired to hold and display other bottled items. In this regard, the following description of a wine rack design is presented for purposes of illustration and description. Furthermore, the description is not intended to limit the invention to the form disclosed herein. Consequently, variations and modifications commensurate with the following teachings, and skill and knowledge of the relevant art, are within the scope of the design. The embodiments described herein are further intended to explain modes known of practicing the invention and to enable others skilled in the art to utilize the invention in such, or other embodiments and with various modifications required by the particular application(s) or use(s) of the design.

The present application recognizes that for many wine enthusiasts, the proper storage of individual wine bottles is very important. For instance, wine collectors often spend considerable sums of money on wine collections. Accordingly, storage systems for wine are of considerable importance to such collectors and should share a number of important features. For instance, it is desirable that individual wine bottles be stored in a horizontal position in order to maintain the physical condition (e.g., moisture content) of corks. It is also desirable that the wine bottles be spaced to permit airflow between individual bottles. Finally, it is also desirable that the bottles be secured within a storage system such that the bottles are not permitted to unintentionally fall from the storage system upon the storage system being bumped or otherwise shaken. As will be appreciated, some wine regions (e.g., California) are prone to earthquakes.

In addition, it may be desirable for a wine rack system to allow for viewing of individual labels without having to remove a wine bottle from the wine rack. Further, it may be desirable to maintain the integrity of labels on the wine bottles. In this regard, it will be appreciated that for wine collectors the condition of the wine labels on a bottle are of some importance. That is, if the wine labels of the bottles are damaged, the value of the bottle of wine may be impaired. This is true for both the body label of a wine bottle as well as the neck label of the wine bottle. Therefore, it may be desirable that the wine storage system and allow for reducing contact with such labels while securely holding the wine bottle and permitting inspection thereof. Accordingly, the inventive wine rack systems disclosed herein allow for holding multiple wine bottles in a horizontal configuration to maintain cork moisture, permitting airflow between individual bottles, while securely holding individual bottles in instances where shaking or jostling may occur. Furthermore, the presented systems may reduce wear that may be applied to one or both labels of a wine bottle.

FIG. 1 illustrates a first embodiment of wine rack system 100 in accordance with various aspects of the present invention. As illustrated, the wine rack system 100 includes vertical support elements 110 that support horizontal frame structures which each support multiple wine bottles. Specifically, the horizontal frame structures are formed of first and second horizontal support frames 120, 122. As illustrated, the first horizontal support frame forms a front support frame 120 and the second horizontal support frame forms a rear support frame 122. It will be appreciated that a plurality of pairs of front and rear frames 120, 122 may extend between corresponding vertical support elements 110. Further, the number of pairs of such front and rear support frames 120, 122 and/or the spacing of the same may be selected based on aesthetic considerations and/or physical constraints of a room into which the wine rack system is incorporated. In one embodiment, the spacing between adjacent pairs of front and rear support frames 120, 122 may be increased in order to permit better visual inspection of body labels of individual wine bottles.

In any arrangement, a plurality of bottle support elements 130 extend between the front and rear supports 120, 122. These bottle support elements are generally formed of elongated members (e.g., boards or staves) that have first and second ends that are inset into corresponding apertures formed in the vertical side surfaces of the front and rear support frames 120, 122. The spacing between each individual pair of bottle support elements 130*a*, 130*b* is such that a wine bottle 200 disposed between such a pair of bottle support elements 130*a*, 130*b* extends partially there between. That is, a horizontal spacing between each pair of bottle support elements 130*a*, 130*b* is less than the width of the wine bottle 200. In this regard, when a wine bottle 200 is placed in horizontal position on the support elements 130*a*, 130*b*, the body of the bottle is supported by the elements and rests partially there between.

In order to reduce the potential for wear on the body label of a bottle of wine 200 supported by the support elements 130*a*, 130*b* the support elements are rounded. That is, all hard edges are removed from the support elements in order to lessen the possibility of the support elements abrading the body labels 202 of the supported wine bottles 200. In one such arrangement the support elements 130 are formed of, for example, round wooden dowels or other circular rods. In such an arrangement, apertures 124, 126 formed within the horizontal surfaces of the front and rear supports 120, 122 may also be round. See FIG. 2. Further, such apertures 124, 126 may be sized slightly larger than the diameter of the support elements 130. In such an arrangement, the support elements 130 may be suspended between the apertures formed and the supports 120, 122 but not physically constrained. That is, the support elements 130 may rotate. In this regard, if the bottle is physically turned while it is laying on the support elements 130*a*, 130*b*, the support elements may roll further reducing any abrading force that may be applied to the bottle 200. It will be further appreciated that such support elements 130 may be coated to further reduce potential for abrading a bottle. For instance, a rubberized coating or sleeve may be applied to the support elements 130 prior to being inserted into apertures within the front and rear support frames 120, 122. Finally, it should be noted that to improve the rotation of the support elements 130, bearing assemblies may be incorporated into the apertures formed in the horizontal surfaces of the front and rear supports 120, 122. However, this is not requirement.

Figure 2:
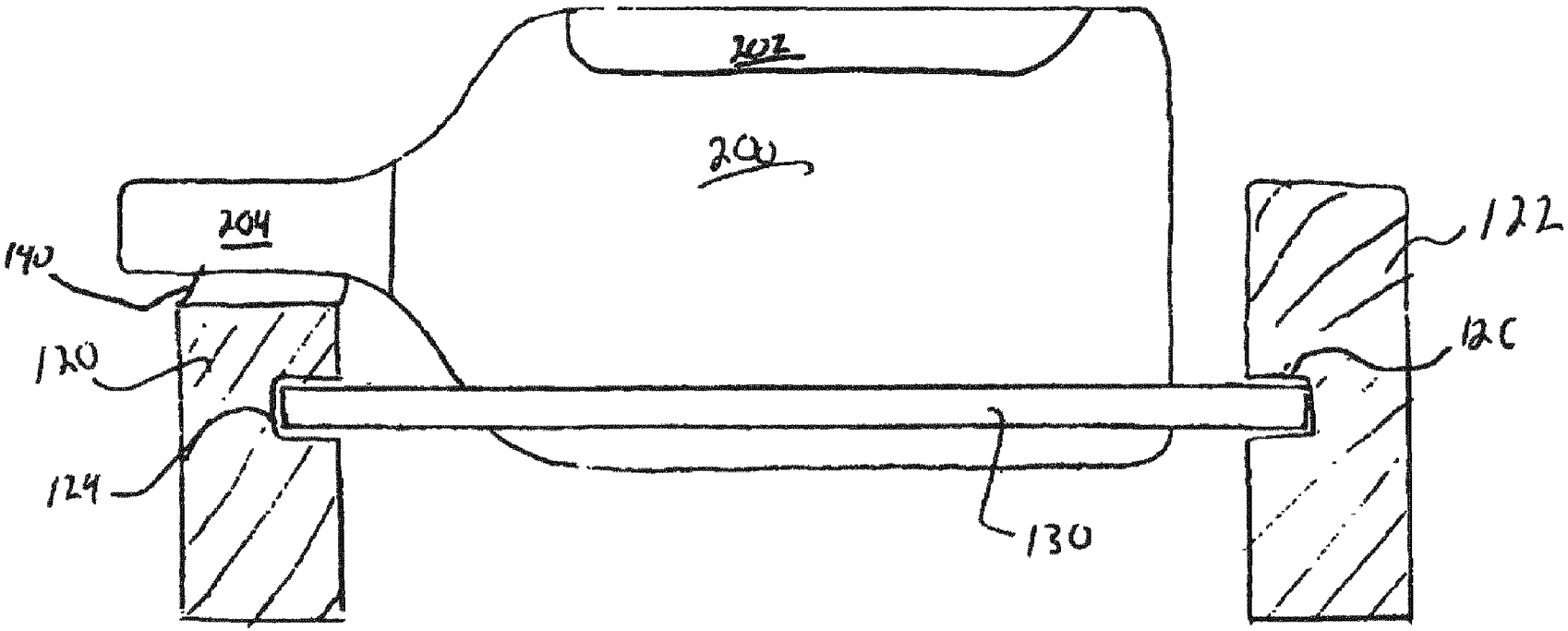
FIG. 2 illustrates a cross-sectional side view of a portion of the wine rack system of FIG. 1.

Referring to FIGS. 1 and 2, is noted that in the front support frame 120 includes a plurality of cutouts 140 that allow for the neck of a bottle 200 to extend partially through the front support frames 120. This allows for easily inserting and removing the bottles from the wine rack system 100. However, it will be noted that many bottles include a neck label 204. Accordingly, if the neck of the bottle rested upon the cutout 140 there could be potential to damage the neck label 204. To prevent such damage, the present system 100 utilizes cutouts 140 that are disposed beneath the neck of bottle supported by the support members 130. Stated otherwise, the support members 130 are positioned into the front support frame 120 at a height that elevates the neck of the support of bottle above the surface of the cutout 140. Accordingly, this lessens the likelihood of abrasion between the cut out 140 and the neck label 204.

Still referring to FIG. 2, it is noted that when a bottle 200 is positioned between the front and rear supports 120, 122 the bottle is protected from dislodgment from the wine rack system 100 by the front and rear supports. Of further note, the rear support 122 provides an end plate that is positioned between the rearward end of the bottle and, for example, a wall against which the wine rack system is mounted. It is regard, it will be noted that wine cellars often have brick or concrete walls. If a racking system is utilized that does not provide an end plate, the end of the bottle may contact the wall if the racking system is jostled. Accordingly, this may result in damage in or breakage of bottles. In contrast, the present system utilizes the rear support 122 as a buffer between the wall and the end of the bottle. As will be appreciated, the front and rear supports are typically formed of wood and contact between the bottle and the wooden surfaces of these supports 120, 122 is unlikely to result in breakage of a wine bottle.

Figure 3:
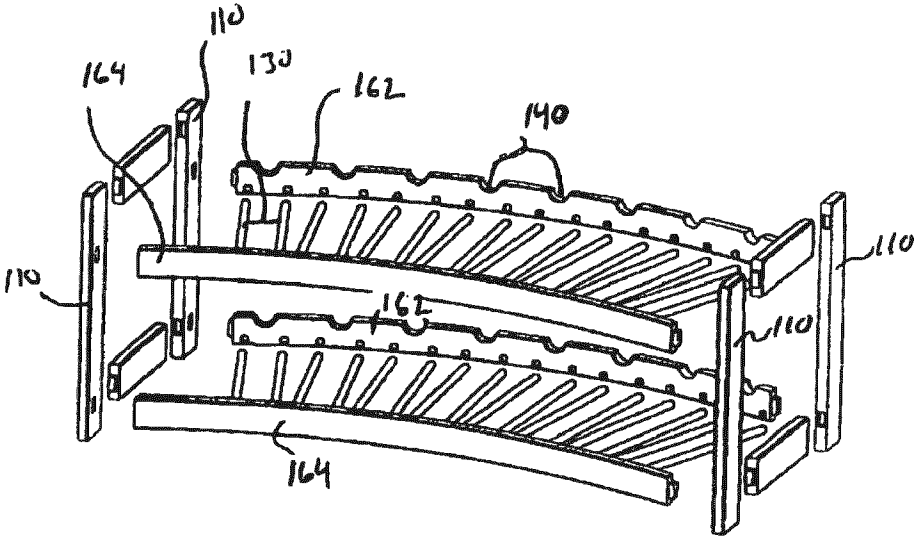
FIG. 3 illustrates an exploded vie of a second embodiment of the wine rack system in accordance with aspects of the invention.
Figure 4:
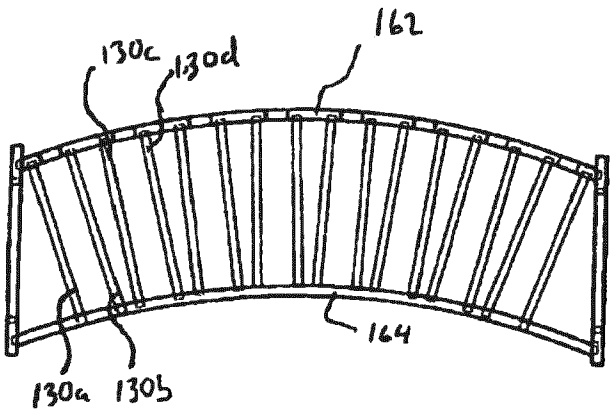
FIG. 4 illustrates a top view of the embodiment of FIG. 3.
Figure 5:
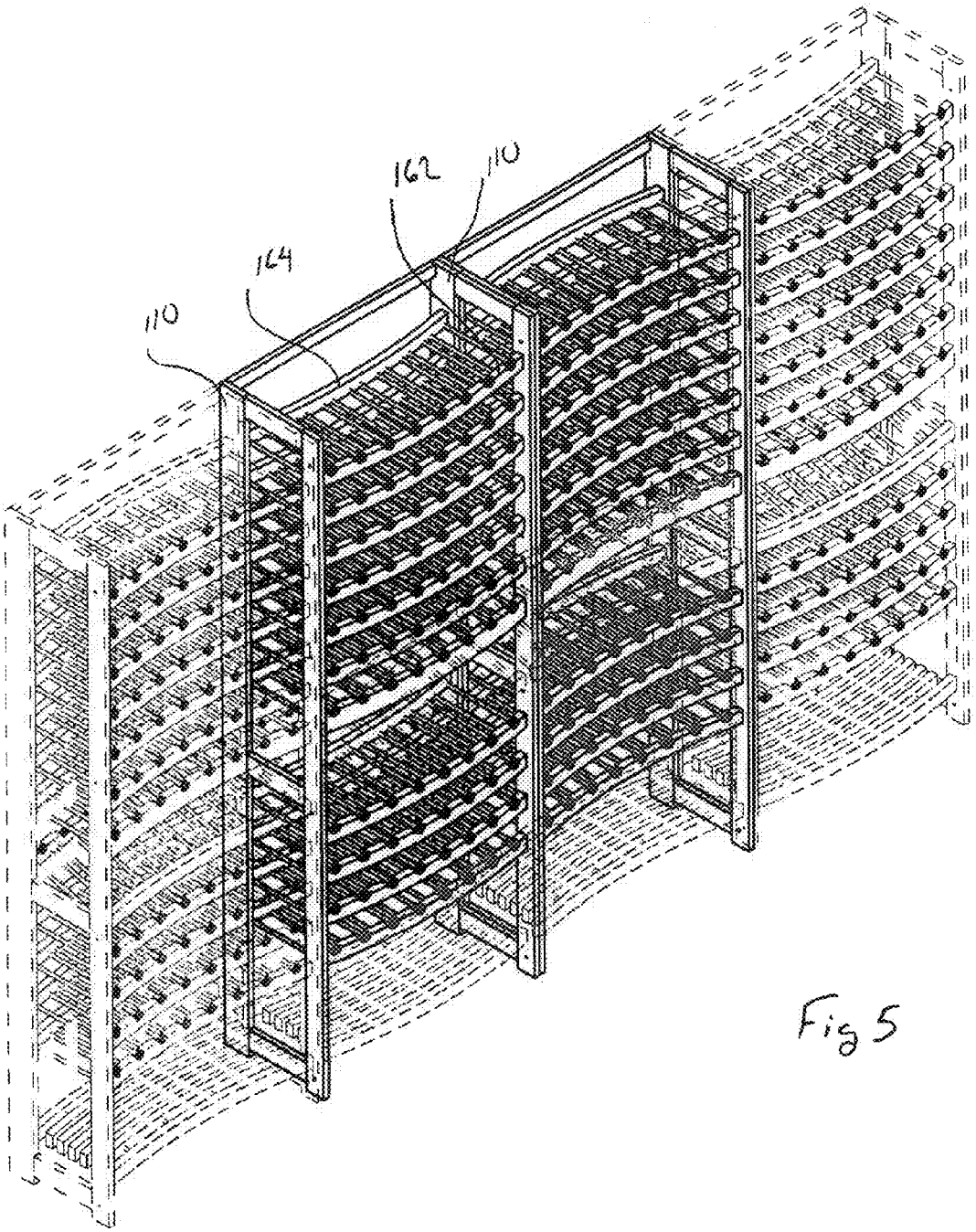
FIG. 5 illustrates a modular embodiment of the wine rack of FIGS. 3 and 4.

FIGS. 3-5 illustrate a further embodiment of a wine rack system 160 in accordance with various aspects of the present invention. As shown, this embodiment of the wine rack system 160 utilizes bowed horizontal supports. More specifically, the front and rear supports 162, 164 are arcuate and may be formed from barrel staves. In the winemaking industry, barrels are often formed of various different woods (e.g., white oak). The wood provides flavoring for the wine. The first time a barrel is used, the wine may be in contact with the wood for around six to nine months. On its second and third uses that barrel can be used for a longer time. This is because less flavor is extracted from a barrel each time it is used. Barrels typically provide flavor for about three to four years at which time the wood of the barrel provides little flavoring and is retired. By some accounts, over 200,000 wine barrels are retired in California each year. Accordingly, there is a ready supply of barrels for use in manufacturing a wine rack system in accordance with aspects of the present invention. Furthermore, use of such staves allows for recycling wood thereby providing an ecological benefit.

When utilizing front and rear barrel staves 162, 164 for horizontal supports, the wine rack system 160 of FIGS. 2 and 3 is substantially similar to that discussed above in relation to FIGS. 1 and 2. In this regard, the horizontal supports and (e.g., barrel staves 162, 164) extend between vertical support, members 110. Again, a plurality of pairs of support elements 130 extend between the front and rear staves 162, 164. In this particular arrangement, it will be appreciated that each pair of support elements 130*a*, 130*b* are generally parallel and are thereby offset in relation to an adjacent pair of support elements 130*c*, 130*d*. See FIG. 4. Likewise, one of the front and rear staves 160, 162 may include plurality of cutouts 140 for receiving the neck of individual bottles stored by the wine rack system 160. Again, a rear stave 164 may form a buffer between the rearward end of a bottle and a backing surface. Use of the bowed barrel staves 162, 164 allows for making convex or concave wine racks as extending between vertical support members 110. It has been determined that curved supports improves the visibility of individual wine bottles supported by the wine rack. That is, as each bottle is offset from adjacent bottles, each bottle, especially those located in the center of the bowed supports may be more easily viewed.

In either of the noted embodiments 100, 160, the wine rack system may be a modular system. That is, a plurality of individual wine racks (e.g., vertical columns) may be disposed side-by-side, or, one or more vertical support members 110 may support for horizontal frame members on opposing sides of the vertical support member. FIG. 5 illustrates a barrel stave wine rack system 160 that utilizes multiple columns. As shown, the system in a modular fashion such that multiple columns of racks are disposed side by side. As illustrated in FIG. 5, a first wine rack column may utilize a plurality of barrel staves 162, 164 that are disposed in a first configuration (e.g., convex) and a second wine rack column may utilize a second configuration (e.g., concave). The result is that multiple such side-by-side wine rack columns result in a horizontal wave appearance.

Figure 6:
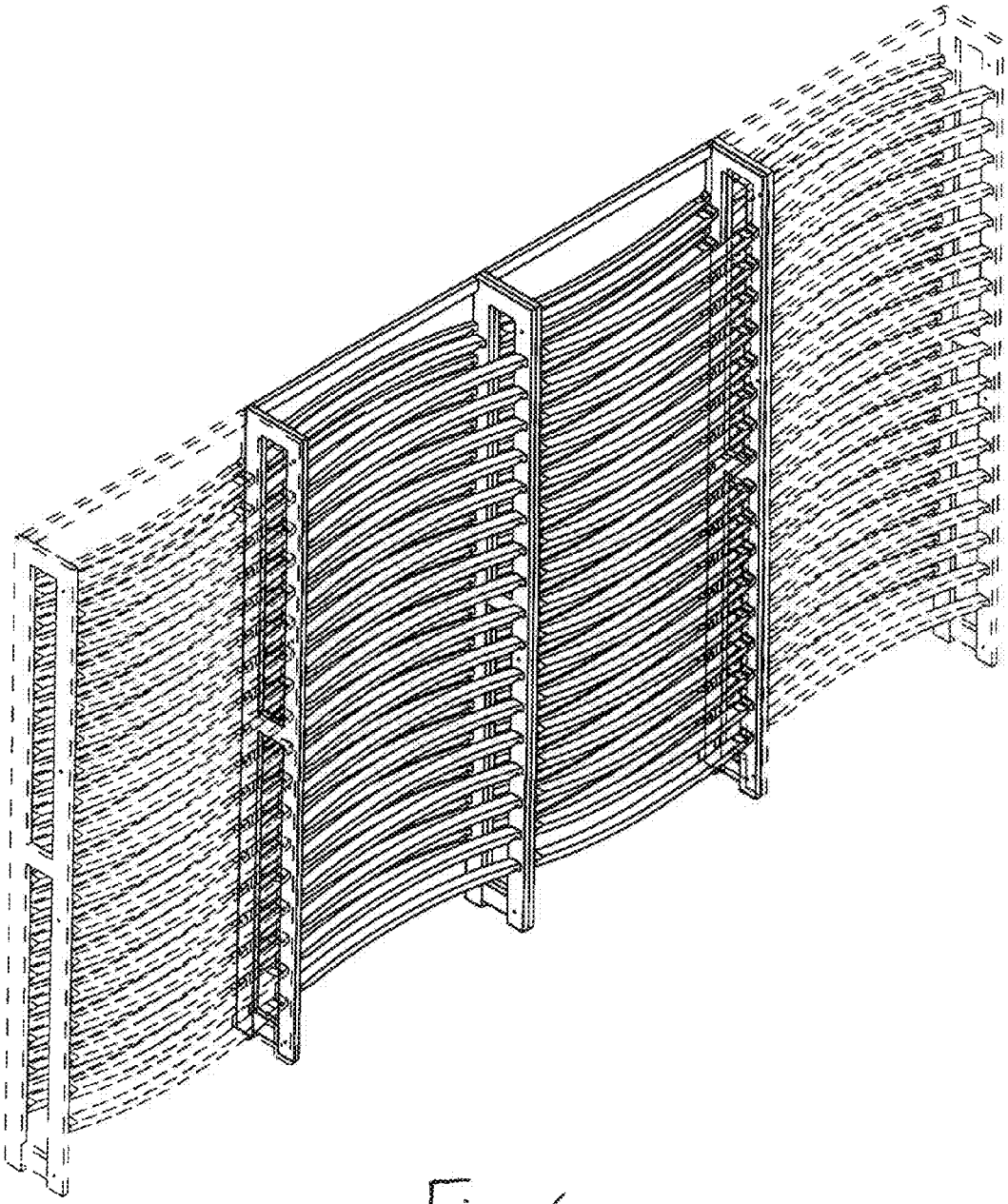
FIG. 6 illustrates a wine rack that utilizes gravity to arrange the bottles thereon.

FIG. 6 illustrates a further embodiment of a wine rack system 170 that utilizes multiple bowed barrel staves to form the racking system. As shown, instead of using support elements that extend between front and rear horizontal support members, the wine rack system 170 utilizes sets of two parallel barrel staves 172 that extend between first and second vertical support elements 110. These barrel staves 172 are parallel in that their respective bowed surfaces are disposed in a common direction. In order to provide a backing for such a rack system, a backing stave 174 may be disposed behind the rearward support stave 172. As will be appreciated, this provides a backing that prevents a bottle stored on the horizontally aligned staves 172 from engaging a wall surface disposed behind the system 170.

It will be appreciated that in this embodiment the wine racking system 170 may not include cutouts for individual bottles. That is, rather than resting on supports 130 that extend between the front and rear supports, the bottles may rest on the barrel staves 172 themselves. Furthermore, due to the curvature of these staves, the bottles may be aligned side by side by gravity. That is, in the case where the staves are upwardly bowed, as illustrated on the left hand side of FIG. 6, wine bottles may roll to outer edges of the rack until they engage the vertical support elements 110 or another bottle held on the racking system 170. In contrast, on the downwardly arranged staves, as illustrated on the right hand side of FIG. 6, the bottles may roll to the center of the downwardly disposed barrel staves 172. In this regard, this system may be preferable for storing wine where the labels of the wine are not of primary importance to the wine owner.

FIGS. 7 and 8A-8E illustrate a further embodiment of a wine racking system 220 in accordance with various aspects of the present invention. The system utilizes a plurality of elongated members disposed within a cabinet to define multiple bins. Such bins are designed to each hold a plurality of wine bottles. To provide airflow through that bins and around the bottles, different sets of elongated members are disposed in an alternating fashion (e.g., interlaced) to define a lattice having spacing between commonly disposed elongated members. As illustrated, this particular system 220 uses a plurality of bowed barrel staves 222 to form the wine holding bins.

Generally, the cabinet of the wine rack system 200 is formed from bottom and top walls 216, 218 disposed between first and second sidewalls 212, 214. The inside surfaces of these walls 212-218 collectively define support surfaces for supporting the elongated staves, which are disposed in an alternating arrangement. That is, the first and second ends of each elongated member are connected to two support surfaces. It will be appreciated that in order to connect the ends of the stave to the support surfaces, it may be desirable to cut the staves at a desired angle and/or utilize dowels, pins or other connections between each individual and the support surface.

Figure 7:
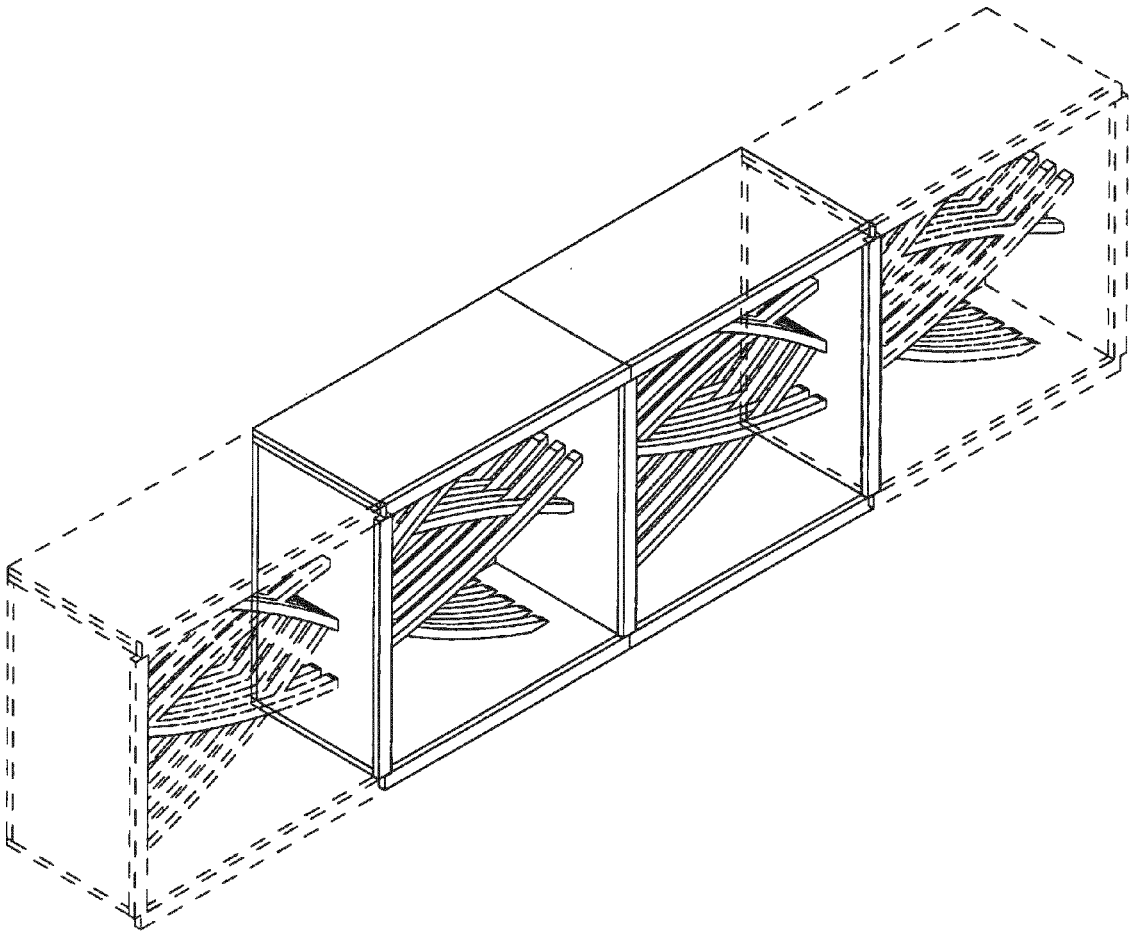
FIG. 7 illustrates a cabinet and bin type wine rack in accordance with aspects of the present invention.

As shown, a first set of staves 222*a* are commonly disposed in a first orientation and a second set of staves 222*b* are commonly disposed in a second different orientation. The individual staves of these sets 222*a*, 222*b* alternate between front and back edges of the support surfaces. The intersection of the differently oriented sets of staves forms a crux in which wine bottles may be stacked. Likewise, the ends of the staves may form a crux with the support surfaces for supporting wine bottles. For instance, where a plurality of staves 222 are disposed within a four-sided cabinet defining four support surfaces, a first stave 222*a* may extend between two of these support surfaces and a second alternating stave 222*b* may extend between two of the support surfaces. In some arrangements, these support surfaces are not the same. For instance, referring to FIG. 8A, a first stave 222*a* may extend between the floor 216 and a first sidewalls 212. A second alternating stave 222*b* may extend between the two sidewalls 212, 214. Disposed immediately behind the second stave 222*b* may be a third stave (i.e., a stave commonly oriented with the first stave 222*a*). As illustrated in FIG. 7, this provides an alternating set of staves that provides a support surface onto which wine bottles may be placed.

Figure 8A:
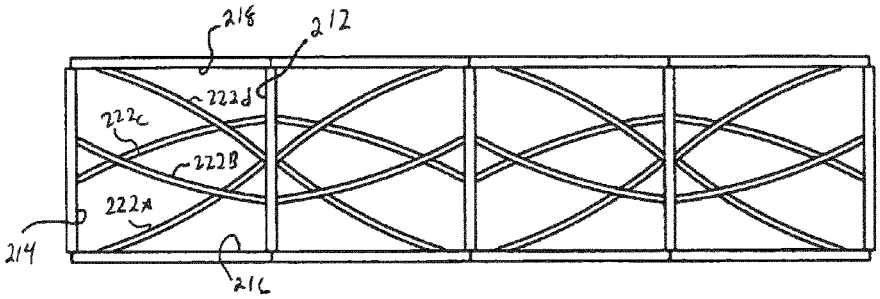
FIGS. 8A-8E illustrate various configurations of the wine rack of FIG. 7.
Figure 8B:
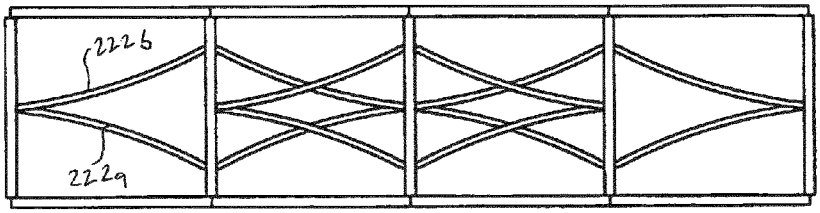
Figure 8C:
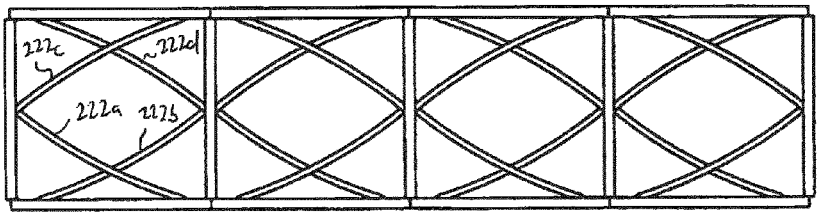
Figure 8D:
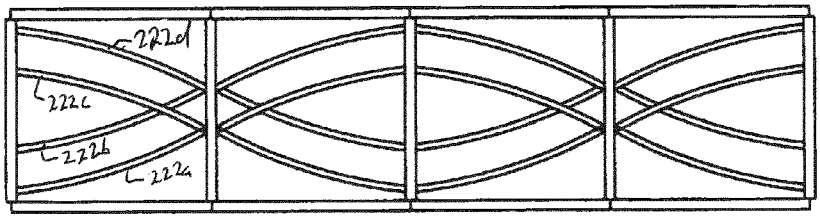
Figure 8E:
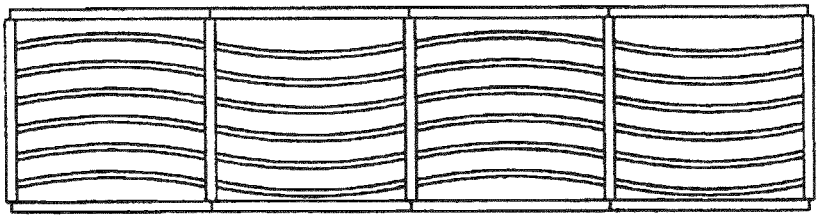

Though discussed in relation to FIG. 8A as having barrel staves extending between different support surface combinations, it will be appreciated that, in other arrangements, such alternating staves may extend between common support surfaces. For instance, as shown in FIG. 8D, the alternating staves may extend between common support surfaces (e.g., sidewalls 212, 214). However, in such an arrangement, at least one end of the alternating stave will be located in different positions relative such a common support surface. As will be appreciated, these separate compartments may be utilized to hold separate vintages of wine.

Irrespective how the staves are arranged in such a cabinet system, it is common that at least four staves are utilized wherein first and third staves are disposed in a first common orientation and the second and fourth staves are oriented in a second common orientation that is different from the first orientation. It will be further appreciated that, in addition to the lower staves 222*a*, 222*b* illustrated in FIG. 8A, additional sets of staves 224*a*, 224*b* may be disposed within the cabinet and may alternate with the other sets of staves. As may be appreciated, the orientation of such staves within the cabinets may provide for a multitude of different configurations as illustrated in a non-limiting matter as set forth in FIGS. 8A-8E.

Utilization of wood from retired wine barrels also provides various marketing opportunities. One such marketing opportunity allows for the promotion of a wine rack made from wood of a particular wine producer. In this regard, wine racks may be offered for sale from different producers. This may allow consumers to buy a wine rack that is produced from wine barrels of, for example, a preferred wine producer of that consumer. In a further arrangement, a marketing opportunity may be provided for the joint promotion of wine and a wine racking system. In this regard, wine of a particular vintage from a particular wine producer may be offered in conjunction with a wine racking system made from barrels of that same particular vintage from the same wine producer. Such a wine racking system may be marketed as a conversation piece for wine enthusiasts. Furthermore, it will be appreciated that wood from such wine barrels often retains staining and/or aromas associate with the wine that was contained within the barrels. Accordingly, it may be preferable to leave the wood from the barrels in their natural state. In this regard, the wine rack may include staining and or aromas associate with the wine that it held.

The foregoing description of the wine rack design has been presented for purposes of illustration and description. Furthermore, the description is not intended to limit the invention to the form disclosed herein. Consequently, variations and modifications commensurate with the above teachings, and skill and knowledge of the relevant art, are within the scope of the invention. For instance, rather than and placing the front and rear support frames 120, 122 in a level configuration between vertical supports, it may be desirable to lower the front support frame 120 slightly in relation to the rear support frame 122. For instance, the front support frame may be 15 degrees lower that the rear frame 122. In such an arrangement, the labels of bottles held by such a system may be more easily viewed. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A wine rack comprising:

a first plurality of bowed frame structures connected to a first pair of vertical side support elements, each of the bowed frame structure comprising:

a plurality of pairs of spaced parallel support rods, wherein a reference axis defined by the parallel support rods of each pair of support rods is offset from the reference axes of adjacent pairs of support rods;

a front arcuate element that arcs in a horizontal plane for restricting movement of the wine bottles toward the fore of the wine rack, the front arcuate element having a plurality of receiving holes for attaching to a first end of each of the plurality pairs of support rods;

a rear arcuate element that arcs in a horizontal plane for restricting movement of the wine bottles toward the aft of the wine rack, the rear arcuate element having a plurality of receiving holes for attaching to a second end of each of the plurality of pairs of support rods;

wherein each pair of the plurality of pairs of support rods is adapted to support one wine bottle in a substantially perpendicular fashion between the front arcuate element and the rear arcuate element.

2. The wine rack of claim 1, wherein the front arcuate element further includes a plurality of cut-outs for receiving necks of the plurality of wine bottles.

3. The wine rack of claim 2, wherein the support members in each of the pairs of support members are spaced apart so as to support a wine bottle from among the plurality of wine bottles so that the neck of the bottle sits within a neck cut-out but does not contact the front arcuate element.

4. The wine rack of claim 1, wherein the plurality of support members are cylindrical in shape.

5. The wine rack of claim 4, wherein the diameters of the plurality of receiving holes in the front arcuate element and the diameters of the plurality of receiving holes in the rear arcuate element are greater than the diameter of the cylindrical support members.

6. The wine rack of claim 1, further comprising, a third vertical side support element; and a second plurality of bowed frame structures connected to one of said first pair of vertical side support elements and said third vertical side support element.

* * * * *